United States Patent [19]
Iyoda et al.
[11] 4,290,406
[45] Sep. 22, 1981

[54] IGNITION SYSTEM FOR INTERNAL COMBUSTION ENGINE

[75] Inventors: Michio Iyoda, Aichi; Shigeya Abe, Kariya, both of Japan

[73] Assignee: Nippondenso Co., Ltd., Kariya, Japan

[21] Appl. No.: 6,914

[22] Filed: Jan. 26, 1979

[30] Foreign Application Priority Data

Mar. 14, 1978 [JP] Japan ..... 53/29588

[51] Int. Cl.[3] ..... F02P 3/04; F02P 11/00
[52] U.S. Cl. ..... 123/645; 123/644
[58] Field of Search ..... 123/148 E

[56] References Cited

U.S. PATENT DOCUMENTS 3,100,479 8/1963 Wood ..... 123/148
3,206,613 9/1965 Clifton ..... 123/148
3,682,150 8/1972 Ford ..... 123/148 E
3,882,840 5/1975 Adamian et al. ..... 123/148 E
3,910,247 10/1975 Hartig ..... 123/148 E
3,913,549 10/1975 Crisafulli ..... 123/148 E
3,937,193 2/1976 Kim ..... 123/117 R
3,949,722 4/1976 Linstedt et al. ..... 123/148 E
4,030,468 6/1977 Sugiura et al. ..... 123/148 E
4,117,820 10/1978 Kashiwazaki et al. ..... 123/148 E
4,130,101 12/1978 Jundt et al. ..... 123/148 E
4,147,145 4/1979 Domland et al. ..... 123/148 E

*Primary Examiner*—Tony M. Argenbright
*Attorney, Agent, or Firm*—Cushman, Darby & Cushman

[57] ABSTRACT

A control signal the value of which gradually changes in response to the turning on of a switching element connected in series to the primary winding circuit of an ignition coil is generated. By use of this control signal, the voltage across the primary winding is caused to rise slowly when the switching element is on, thus preventing an unnecessary high voltage from being generated across the secondary winding of the ignition coil.

7 Claims, 18 Drawing Figures

IGNITION SYSTEM FOR INTERNAL COMBUSTION ENGINE

BACKGROUND OF THE INVENTION

This invention relates to an ignition system for internal combustion engines, or more in particular to an ignition system using a semiconductor element, especially a power transistor as a switching element for the primary winding circuit of the ignition coil.

In conventional ignition systems utilizing the opening and closing of a mechanical contact or breaker point, a capacitor of about 0.15 $\mu$F to 0.25 $\mu$F is connected in parallel to the breaker point. This capacitor affects the opening speed of the breaker point but not the closing speed thereof, i.e., the speed at which the source voltage is applied to the ignition coil. Therefore, simultaneously with the closing of the breaker point, the source voltage is substantially applied across the primary winding of the ignition coil.

In an electronic ignition system including a transistor ignition system having a semiconductor element such as a transistor or thyristor as the switching element for the primary winding circuit of the ignition coil, the operating speed of the switching transistor is such that the time from the turning off of the transistor to the application of predetermined voltage to the primary circuit of the ignition coil is about 1 to 5 microseconds, and the transistor is turned on at substantially the stable speed of 5 to 40 microseconds. Therefore, at the same time that the switching transistor is turned on, the source voltage is applied across the primary winding of the ignition coil. In another type of electronic ignition system having a thyristor as the switching element, a surge absorber including a series circuit of a resistor and a capacitor is connected in parallel to the thyristor. This series circuit reduces the surge but fails to control the switching speed of the thyristor.

As mentioned above, regardless of whether the mechanical contact or the electronic device such as transistor or thyristor is used as the switching element, the speed at which the switching element is turned on is not controlled. As soon as the switching element is turned on, therefore, the source voltage less the saturation voltage of the switching element is applied across the primary winding of the ignition coil, so that the primary current determined by the primary winding and an external resistance making up the primary circuit starts to flow in the ignition coil. Although in the prior art attention is paid only to the fact that a high voltage is generated in the secondary winding of the ignition coil by the turning off of the switching element and the resulting cutoff of the primary circuit, a transient phenomenon occurs of course also at the time of closing of the primary winding circuit, with the result that the secondary high voltage is generated in the secondary side of the ignition coil. The secondary high voltage generated in the secondary winding in response to the closing of the primary winding circuit of the ignition coil is reverse in polarity to the secondary high voltage generated in response to the opening of the primary winding circuit, but they are substantially equal to each other in the frequency of output voltage. Such an output voltage waveform is shown in FIG. 1. In this figure, a and c show output voltage waveforms generated in the secondary winding of the ignition coil at the ignition timings. Specifically, a shows an open waveform for the secondary side without generation of any spark, c a waveform associated with break with generation of a spark, and b a waveform associated with conduction of the primary side of the ignition coil. The secondary high voltage, i.e., V2 in FIG. 1 at point b takes a value about one tenth of the output voltage level at the ignition timings, but it sometimes takes a voltage from 2 to 4 kv depending on the ignition coil when the source voltage is 14 volts. The source voltage characteristics of the high voltage generated in the secondary winding when the primary winding circuit of the ignition coil is closed is shown in FIG. 2. This secondary high voltage increases substantially in proportion to the source voltage, and has different output levels depending on the variety of the ignition coil as shown by a, b and c.

As described above, a secondary high voltage is generated in the secondary winding even when the primary winding circuit of the ignition coil is closed. This secondary high voltage sometimes undesirably causes the ignition plug to be fired. This is because the secondary high voltage is connected to the ignition plug generally through a distributor or, directly in the case lacking the distributor. The breakage of the secondary high voltage and the resulting firing at a point different from normal ignition timing is liable to cause irrevocable damage to the engine. In most of the distributors of rotary type, the angular point when the ignition coil is turned on is fixed. Namely, in most case the ignition coil is turned on almost when the rotor in a distributor comes to the center between the distribution terminals and therefore a considerable air gap exists between rotor and distributor terminal, thus substantially but not entirely eliminating the possibility of actuation of the ignition plug. In the ignition system in which the closing angle is subjected to variable control, the position b in FIG. 1 may be located at a given point between points a and c, so that the air gap is not sufficiently large and the breakage of ignition plug causes trouble in the engine, thus making it necessary to take such measures as enlarging the diameter of the high voltage distribution section of distributor. In the ignition system in which the secondary high voltage is directly applied to the ignition plug, on the other hand, the turning on of the switching element and the resulting high secondary voltage generated across the secondary winding of course causes trouble in engine operation. Further, the increased arc energy, the increased arc current and the increased secondary voltage due to the grading up of the ignition system to high performance leads to large amplification of the secondary high voltage across the secondary winding from the voltage applied across the primary winding, further increasing the chance of engine trouble.

The present inventors have conducted a test using such a high-performance ignition system, applying a voltage across the primary winding of ignition coil by turning on the switching element, and observing the arc generated by the ignition plug being fired. The results of this test show that the arc generated when the switching element is turned on has substantially the same duration, arc current and arc energy as the arc generated at normal ignition timing and that the generation of this abnormal arc adversely affects the engine. The secondary high voltage waveform and arc current waveform generated when an arc is generated by turning on the switching element and when the switching element is turned off with the ignition coil primary current cut off are shown in FIG. 3 respectively.

The adverse effects on the engine are shown in the diagram of FIG. 4 illustrating pressure in cylinder. In this drawing, in case of normal ignition, the pressure peak appears about 10 degrees after the top dead center as shown by solid line, while the pressure peak point in case of arc generation in response to the turning on of the switching element is reached almost at the top dead center as shown by dashed line, and the pressure level at that time is twice or thrice the normal pressure, resulting in a higher rate of pressure increase. At the time of generation of the pressure shown by the dashed line, the engine torque is reduced sharply on the one hand and the engine may be seriously damaged on the other hand. Other disadvantages that may occur in such a case include knocking, after-burn and other undesirable phenomena.

SUMMARY OF THE INVENTION

An object of the present invention is to provide an ignition system, in which, in order to obviate the above-described disadvantages, the primary current flowing in the ignition coil by application of a voltage to the primary winding of the ignition coil is increased slowly, thus preventing the secondary high voltage from being generated unnecessarily in the secondary side. In this way, the unnecessary ignition of the ignition plug is prevented completely, thus assuring safe operation of the engine.

DESCRIPTION OF THE PREFERRED EMBODIMENTS

Embodiments of the present invention will be explained with reference to the accompanying drawings below.

Figure 1:
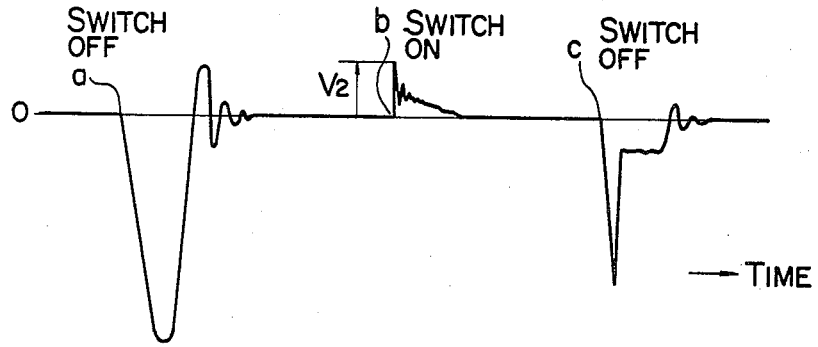
FIG.1 PRIOR ART
FIG. 1 is a diagram showing a waveform of the secondary high voltage generated at the secondary side of the ignition coil.
Figure 2:
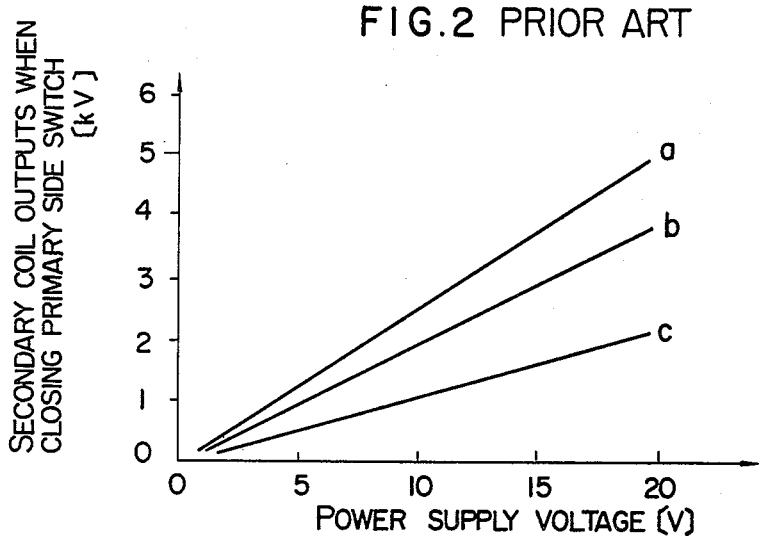
FIG.2 PRIOR ART
FIG. 2 is a characteristics diagram for the secondary high voltage depending on the ignition coil and source voltage.
Figure 3:
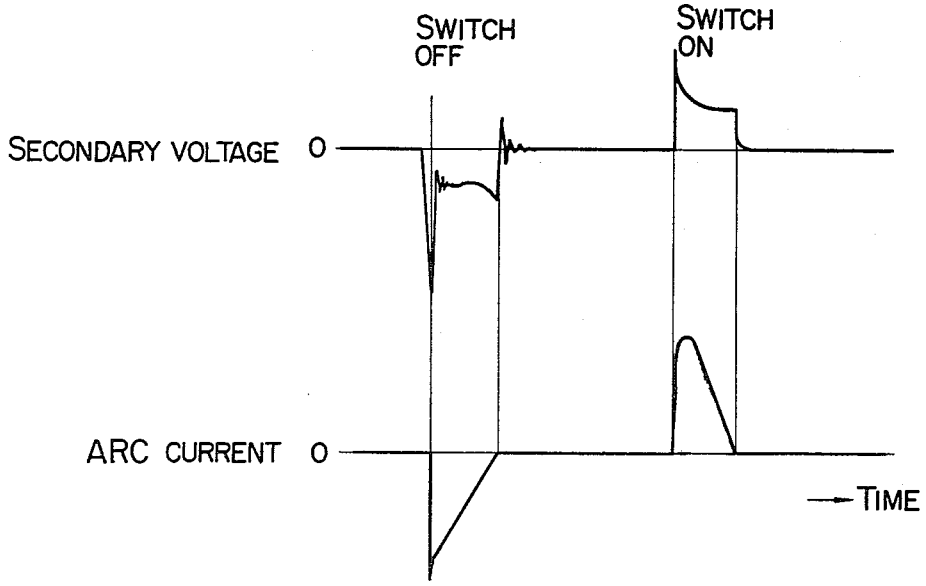
FIG.3 PRIOR ART
FIG. 3 is a diagram showing waveforms of secondary voltage and arc current associated with firing of the ignition plug at normal and abnormal ignition timings.
Figure 4:
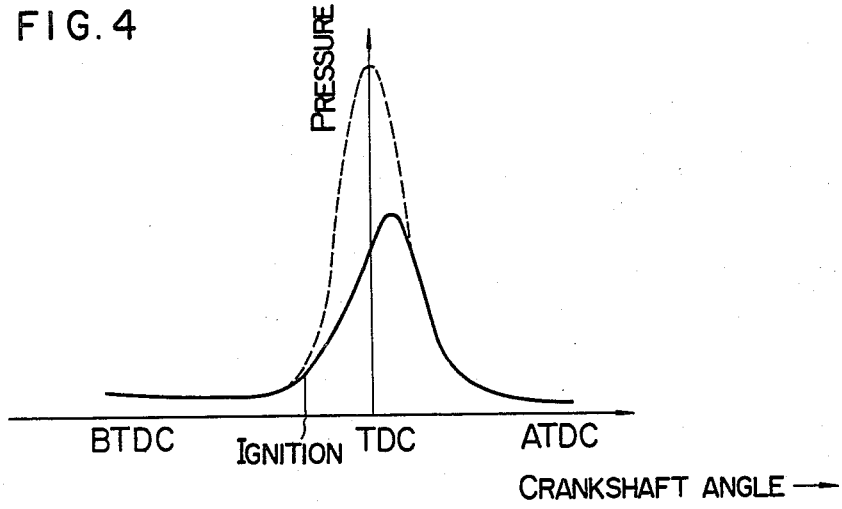
FIG. 4 is a diagram showing the pressures in the cylinder at normal and abnormal ignition timings.
Figure 5:
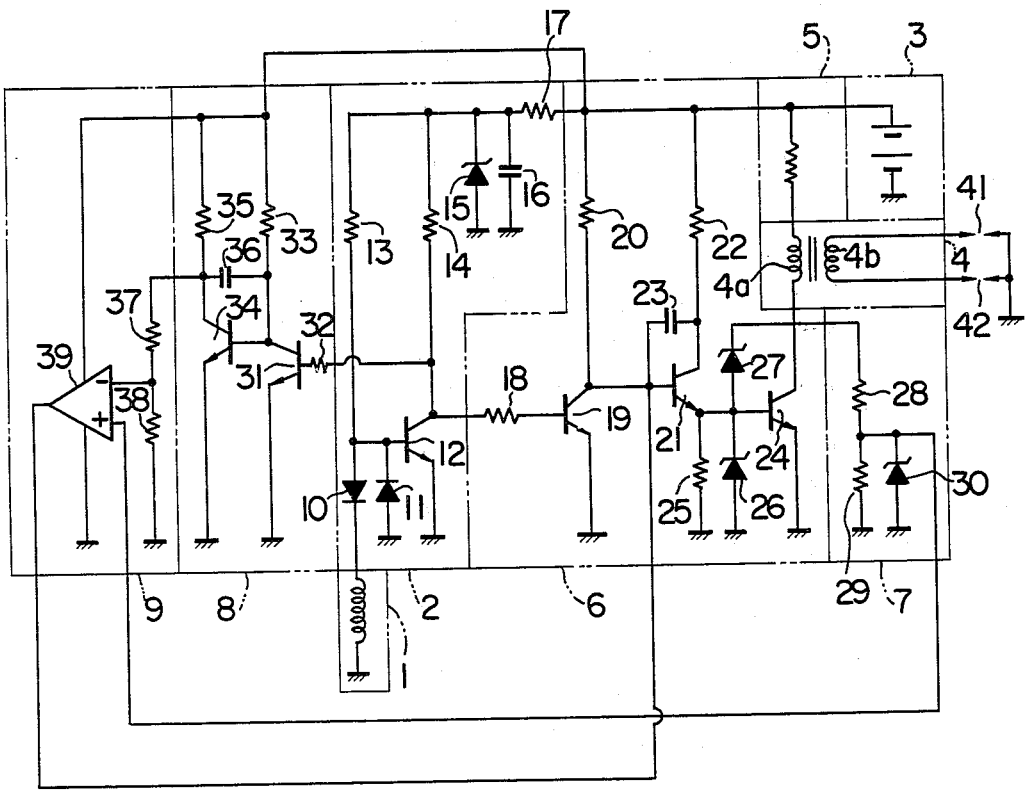
FIG. 5 is a diagram showing an electrical circuit of a first embodiment of the system according to the present invention.

First, explanation will be made of the first embodiment shown in FIG. 5. The first embodiment is such that the unnecessary high voltage generated in the secondary side of the ignition coil is reduced by controlling the source voltage applied to the primary winding of the ignition coil. In FIG. 5, reference numeral 1 shows an AC generator making up an ignition signal generator for generating a signal synchronous with the rotation of the internal combustion engine, numeral 2 a waveform shaping circuit for shaping the waveform of the AC signal generated by the AC generator 1, numeral 3 a battery making up a power supply, numeral 4 an ignition coil having the primary winding 4*a* and the secondary winding 4*b*, numeral 5 an external resistor for limiting the primary current in the primary winding 4*a* of the ignition coil 4, and numeral 6 a switching circuit for amplifying the ignition signal from the waveform shaping circuit 2 and turning on and off the primary current of the primary winding 4*a* of the ignition coil 4. Numeral 7 shows a voltage detector circuit for detecting the coil voltage, numeral 8 a saw-tooth wave generator circuit for generating a saw-tooth wave signal in synchronism with the output signal of the waveform shaping circuit 2, and numeral 9 a comparator circuit including a comparator. The circuit of FIG. 5 will be described more in detail. Numeral 10 shows a temperature-compensated diode, numeral 11 a diode for protecting the transistor 12 from breakdown voltage, numeral 13 a bias resistor for the transistor 12, numeral 14 a load resistor for the transistor 12, numeral 15 a constant-voltage diode, numeral 16 a noise-absorbing capacitor, numeral 17 a dropper resistor for the constant-voltage circuit. Numeral 18 shows a base resistor for the transistor 19, numeral 20 a load resistor for the transistor 19, numeral 21 a current amplifying transistor, numeral 22 a load resistor for the transistor 21, and numeral 23 a capacitor for preventing oscillation having the capacity of approximately 100 PF. Numeral 24 shows a switching transistor functioning as a switching element, which is a power transistor for turning on and off the primary current flowing from the battery through the external resistor 5 and the primary winding 4*a* of the ignition coil 4. The power transistor 24 is connected in Darlington pair with the transistor 21. Numeral 25 shows a resistor between base and emitter of the transistor 24, and numeral 26 a zener diode for protecting the transistor 24 from breakdown voltage. Numeral 27 shows a zener diode for protecting the transistor 24 from breakdown voltage. Numerals 28 and 29 show resistors connected to the collector of the transistor 24 and making up a voltage divider circuit. The zener diode 30 clips a voltage exceeding a certain level. Numeral 31 shows a transistor, numeral 32 the base resistor for the transistor 31, numeral 33 a load resistor for the transistor 31, numeral 34 a transistor, numeral 35 a load resistor for the transistor 34, numeral 36 a capacitor for determining the gradient of the output signal of the saw-tooth wave generator circuit, and numerals 37 and 38 resistors connected to the collector of the transistor 34 and making up a voltage divider circuit. Numeral 39 shows a comparator operated by a single power supply, which is an open collector type having an input comprised of a PNP transistor and an output comprised of an NPN transistor. The output of the comparator 39 is connected to the base of the transistor 21. Numerals 41 and 42 show ignition plugs which are connected to the terminals of the secondary side of the ignition coil 4 and arranged in different cylinders of the internal combustion engine.

Figure 6:
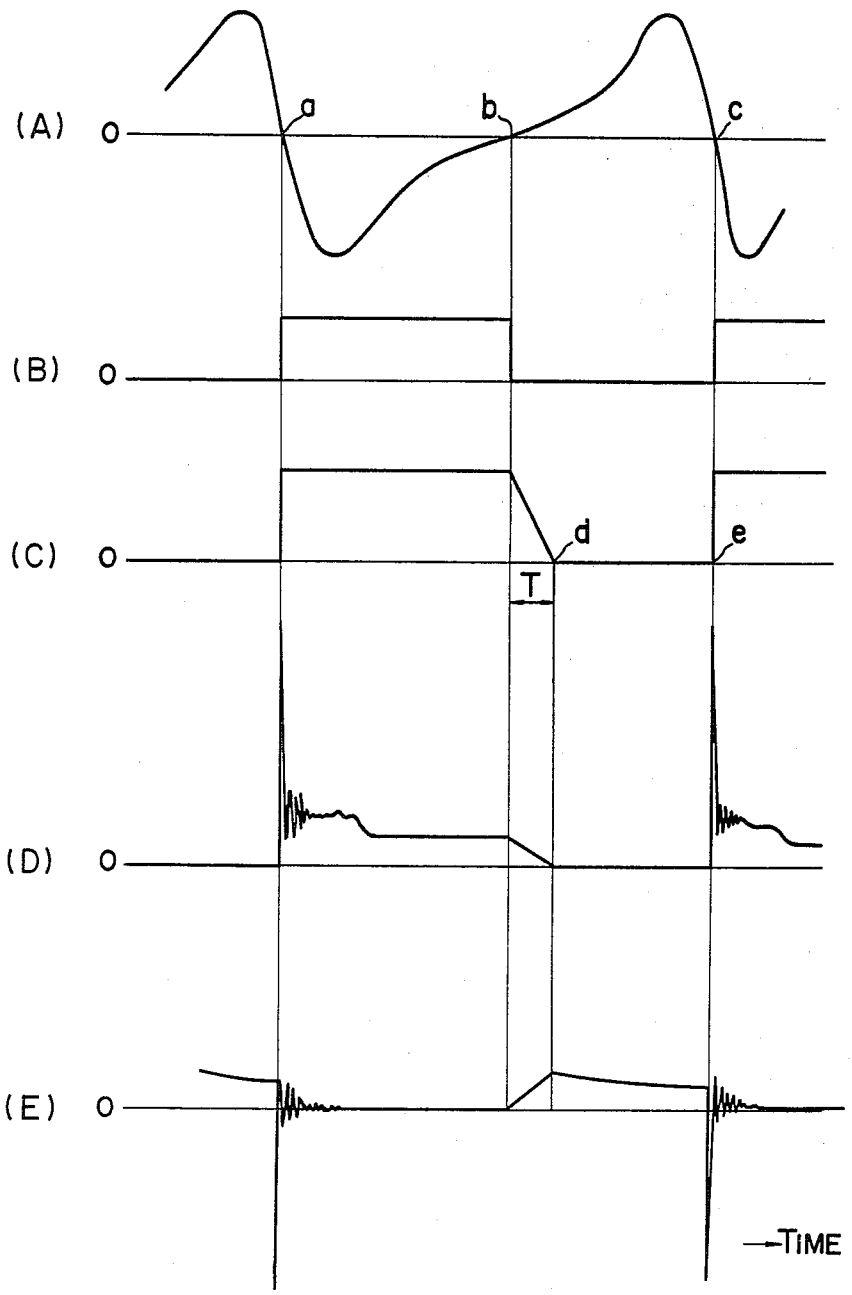
FIG. 6 shows waveforms generated at various parts of the system for explaining the operation of the circuit of FIG. 5.

Next, operation of the circuit having the above-mentioned construction will be explained. The AC signal generator 1 generates an AC signal shown in (A) of FIG. 6 in synchronism with the rotation of the internal combustion engine. In response to this signal, the waveform shaping circuit 2 produces a rectangular wave output signal as shown in (B) of FIG. 6. In response to the low level output signal of this rectangular wave, the power transistor 24 for turning on and off the primary current conducts, while it is turned off in response to the high level output of the same. This is for the reason that in the waveform shown in (A) of FIG. 6 produced by the AC signal generator 1, the transistor 12 is off, transistor 19 on, transistor 21 and power transistor 24 off during the period from a and b; while the reverse is true between b and c, with the result that the power transistor 24 is finally turned off. Thus, at point a in (A) of FIG. 6, the power transistor 24 is turned off, and the primary winding 4*a* of the ignition coil 4 is turned off, so that a high voltage is generated in the secondary winding 4*b*, thus igniting the ignition plugs 41 and 42. At point b, on the other hand, the power transistor 24 is turned on, at which moment a voltage substantially equal to the battery voltage is applied across the primary winding 4*a*. Current begins to flow in the primary winding 4*a* of the ignition coil 4 subject to the time constant determined by the resistor and the inductance making up the primary circuit. After a certain period of time, the saturation value of the current in the primary circuit is reached. Generally, the switching speed of the power transistor 24 used for ignition is about 1 to 5 μsec when the power transistor 24 is on. Therefore, as far as the power transistor 24 is turned on, it is considered to be switched almost instantaneously. By switching the power transistor 24 at high speed in this way, a high voltage accompanying fluctuations is generated across the secondary winding 4*b* of the ignition coil 4. The saw-tooth wave generator circuit 8 uses the well known Miller integrator circuit, the operation of which is described below. Between points a and b in (A) of FIG. 6, the output transistor 12 of the waveform shaping circuit 2 is off, with the result that transistor 31 is on and transistor 34 off. At point b, the transistor 12 is turned on, so that the transistor 19 is turned off and the transistor 31 is also turned off, while the transistor 34 is turned on. The transistor 34, however, is not turned on sharply due to the negative feedback through the capacitor 36. In other words, the collector potential of the transistor 34 does not drop very sharply, thus generating a saw-tooth wave signal. Such a saw-tooth wave is shown in (C) of FIG. 6. This saw-tooth wave varies substantially between the source voltage potential and the collector-emitter saturation voltage level of the transistor 34. This saw-tooth wave is generated at the same timing as the turning on of the ignition coil 4. The decreasing time of the saw-tooth wave, i.e., the time T in (C) of FIG. 6 is set at 200 μsec to 400 μsec. This waveform (C) is divided by the circuit including the resistors 37 and 38 and applied to the comparator 39. On the other hand, the signal from the waveform sharping circuit 2 is applied also to the power transistor 24 through the transistors 19 and 21, so that the power transistor 24 is turned on at point b of the waveform (A) of FIG. 6. The collector signal of this power transistor 24 is divided by the voltage divider circuit 7 and applied to the comparator circuit 39 where it is compared with the above-mentioned saw-tooth wave voltage. The zener diode 30 is so set that when the turning off of the power transistor 24 causes the voltage of 300 to 400 V to be generated at the collector thereof, the voltage exceeding that of the battery 3 is prevented from being applied to the input of the comparator 39. Also, the voltage-dividing ratio between the resistors 37 and 38 is set at the same value as that between the resistors 28 and 29. Thus the collector potential of the power transistor 24 is compared with the potential of the saw-tooth wave generator circuit 8 in the comparator circuit 39. When the collector potential of power transistor 24 is lower than the output voltage of the saw-tooth wave generator circuit 8, the comparator 39 produces a "0" output. In this case, the transistor of NPN open collector type at the output stage is turned on, so that the base potential of the transistor 21 which is biased by the resistor 20 is reduced, thereby turning off the transistor 21. As a result, the power transistor 24 is also turned off, thus increasing the collector potential of the power transistor 24. When the collector potential of the power transistor 24 is higher than the saw-tooth wave voltage, on the other hand, the output level of the NPN transistor at the output stage of the comparator 39 is "1". Under this condition, the transistor 19 is off, and therefore the power transistor 24 is naturally on, so that the collector potential thereof is decreased. In this way, by use of the comparator 39, the collector potential of the power transistor 24 is compared with the saw-tooth wave potential for feedback control. Thus at the time of fall of the saw-tooth wave, the collector potential of the power transistor 24 is caused to fall in the same manner as the fall of the output of the saw-tooth wave generator circuit 8. As a result, it is possible to make arrangement in such a manner that it requires time T before the power transistor 24 is turned on completely (saturation between collector and emitter). Between d and e in (C) of FIG. 6, the transistor 34 is saturated with the saturation voltage from 0.2 to 0.5 V. The power transistor 24, which makes up one of the transistors included in the Darlington pair, is so constructed that the collector-emitter voltage is maintained between 1.0 and 1.5 V by the primary current. As a result, the transistor in the output stage of the comparator 39 is turned off, so that the power transistor 24 is naturally saturated. Between a and b in (A) of FIG. 6, i.e., as long as the output of the waveform shaping circuit 2 is off, the transistor 19 is on. Under this condition, regardless of whether the output of the comparator 39 is on or off, the transistor 21 is off, that is, the power transistor 24 is off due to the open collector type. This indicates that although the fluctuations of the collector potential of the power transistor 24 at the time of ignition cause the comparator 39 to produce an on-off signal, no operation error of the feedback loop occurs. When the transistor 19 is turned on, the power transistor 24 is turned off. The ignition timing does not follow the rise waveform of the saw-tooth wave, but the power transistor 24 is turned off rapidly, thus assuring an accurate ignition timing and a sufficient high voltage across the secondary winding 4*b* of the ignition coil 4. The collector voltage waveform of the power transistor 24 is shown in (D) of FIG. 6, while the voltage applied across the primary winding 4*a* of the ignition coil 4 is illustrated in (E) of FIG. 6.

As noted from the foregoing description, the base current of the power transistor 24 is controlled by the applied voltage regulator circuit comprising the detector circuit 7, the saw-tooth wave generator circuit 8, and the comparator circuit 9. Thus, the rise of the voltage at the time of turning on of the power transistor 24, that is, the rise of the current in the primary winding 4*a* is controlled, while the voltage fall thereof is controlled by the fall of the saw-tooth wave. Also, the fall thereof is easily variable by the capacitor 36, and the operation is not affected after saturation of the power transistor 24 and ignition timing.

The measurement of the secondary output voltage of the ignition coil at the time of turning on of the power transistor 24 in the ignition system of the above construction shows that the output voltage is reduced to 60 to 70% of the case in the absence of control, thus eliminating the possibility of ignition occurring at the time of the power transistor 24 being turned on with the result that the engine is operated safely.

The fall time T generally lasts from 20 μsec to 400 μsec and is amply shorter than the conduction time of the ignition coil. This is almost long enough to cause the current to rise without affecting the dwell angle characteristics. Also, since the current value during this time is so small that the power transistor 24 generates almost the same amount of heat.

Figure 7:
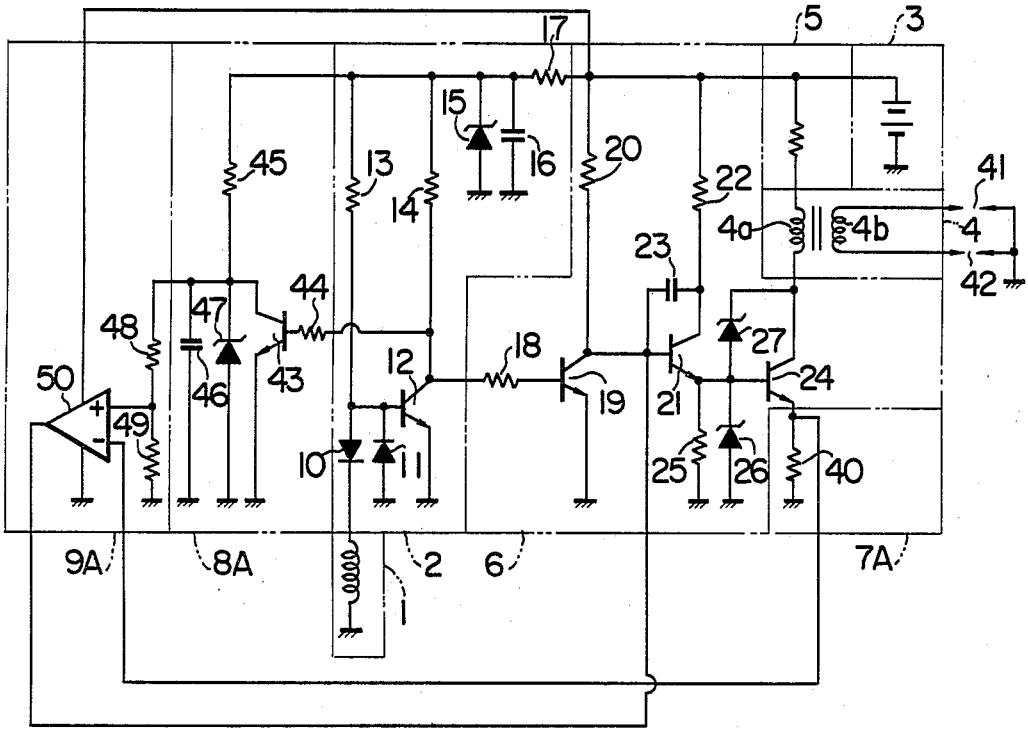
FIG. 7 shows an electrical circuit of a second embodiment of the system according to the present invention.

A second embodiment of the present invention is shown in FIG. 7. Like in the first embodiment shown in FIG. 6, the rise of the primary current of the ignition coil is controlled in order to reduce the secondary high voltage generated at the time when the primary current begins to flow. In FIG. 7, like reference numerals denote like or the same component elements in FIG. 5. Reference numeral 7A shows a current detector circuit inserted between the ground and the emitter of the power transistor 24 for turning on and off the primary current, numeral 8A a triangular wave generator circuit for determining the gradient of the rise of the primary current, and numeral 9A a comparator circuit including a comparator. More specifically, numeral 40 shows a resistor for detecting the primary current, the voltage across which increases in proportion to the current value. The resistance value of the resistor 40 is selected at about 50 to 100 mΩ. The triangular wave generator circuit 8A is for generating a triangular wave in synchronism with the output signal of the waveform shaping circuit 2. Numeral 43 shows a transistor, numeral 44 a base resistor of the transistor 43, numeral 45 a resistor, numeral 46 a capacitor, and numeral 47 a constant-voltage diode. The comparator circuit 9A includes resistors 48, 49, and an open-collector type comparator 50 with a PNP transistor at the input and an NPN transistor at the output. The open-collector output of the comparator 50 is connected to the base of the transistor 21.

Operation of the second embodiment of the above-mentioned construction will be described. The AC generator 1 generates an AC signal as shown in (A) of FIG. 8. This AC signal is shaped by the waveform shaping circuit 2 into the waveform as shown in (B) of FIG. 8 as in the first embodiment. During the period from a to b, the transistor 12 is off, and during the period from b to c, it is on. On the other hand, the transistor 19 is on from b to c, and off between b and c. The power transistor 24 is off from a to b, and on from b to c. The ignition timing occurs at points a and c. At point b, the power transistor 24 is turned on and the primary current begins to flow in the ignition coil 4. On the other hand, the triangular wave generator circuit 8A operates in synchronism with the transistor 12. The transistor 43 is on when the transistor 12 is off, and off when the transistor 12 is on. When the transistor 12 is turned on, the transistor 43 is turned off, so that the capacitor 46 begins to be charged at the time constant almost determined by the resistor 45 and the capacitor 46. In view of the fact that the zener voltage of the constant-voltage diode 47 is set lower than the zener voltage of the constant-voltage diode 15, the potential of the capacitor 46 is clipped at V1 by the constant-voltage diode 47 as shown in (C) of FIG. 8. The rise portion thereof, therefore, substantially takes a triangular form, and this voltage is divided by the resistors 48 and 49 and is applied to the comparator 50 as a target current setting. Thus in synchronism with the turning on of the transistor 12, the power transistor 24 is turned on and the transistor 43 is turned off, so that a triangular wave is generated in the capacitor 46. As soon as the power transistor 24 is turned on, the primary current begins to flow. This primary current is fed back to the comparator 50 by the detection resistor 40 and compared with the current setting by the triangular wave. When the primary current in the ignition coil 4 is larger, i.e., when the potential of the detection resistor 40 is larger than the target value, the open collector type NPN output transistor of the comparator 50 is turned on, thus reducing the base potential of the transistor 21 and preventing the flow of the primary current. As a result, the oscillation waveform at the time of rise of the primary current is decreased, with the result that the unnecessary secondary high voltage generated in the secondary coil 4*b* of the ignition coil 4 is reduced.

Figure 8:
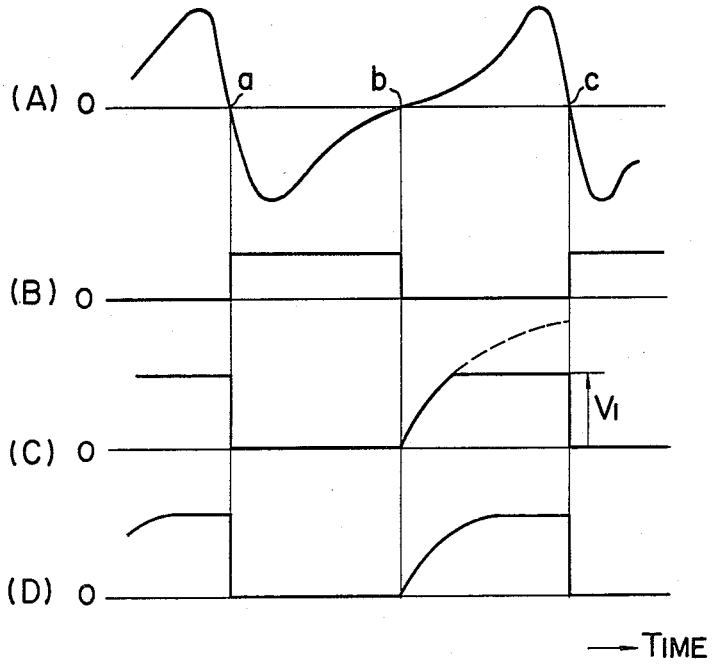
FIG. 8 is a diagram showing waveforms generated at various parts of the circuit shown in FIG. 7 for explaining the operation thereof.

In the embodiment of FIG. 7, the potential of the resistor 49, i.e., the current setting thereof is set at a point larger than the potential of the detection resistor 40 for the saturation of the primary current shown in (D) of FIG. 8 by means of the voltage-dividing ratio of the resistors 48 and 49. Therefore, the saturation of the primary current is not affected. In the ignition system in which the primary current is subjected to constant-current control, on the other hand, the rise of the primary current is controlled by the resistor 45 and the capacitor 46, and the saturation value by voltage division by the resistors 48, 49 and the constant voltage diode 47 more advantageously.

Figure 9:
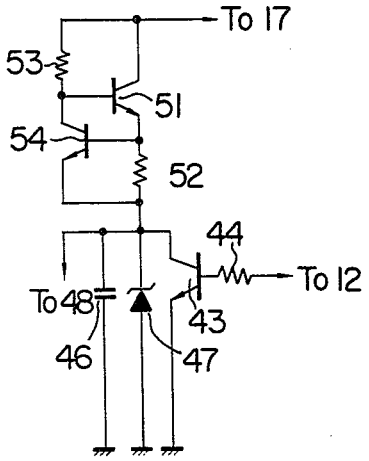
FIG. 9 is an electrical circuit diagram showing the essential parts of a third embodiment of the present invention.

The essential parts of the third embodiment of the present invention are shown in FIG. 9. This embodiment is improved over the second embodiment of FIG. 7, in that differing from the second embodiment in which the capacitor 46 of the triangular wave generator circuit 8A is charged through the resistor 45, the rise timing is further improved by use of a well-known constant-current circuit. In FIG. 9, numeral 51 shows a transistor, numeral 52 a resistor, numeral 53 a resistor, numeral 54 a transistor. The operation of this third embodiment is the same as that of the second embodiment. The only difference is that the charging function of the capacitor 46 is improved in such a manner that the transistor 51 is biased by the resistor 53 and the charge current flows through the transistor 51 and the resistor 52. In the case of current larger than the current setting, the voltage drop across the resistor 52, i.e., the base-emitter potential of the transistor 54 is so high that the transistor 54 is turned on and the base potential of the transistor 51 is reduced. As a result, the charging current is reduced, and the function of a constant-current circuit is performed, thus generating a more exact triangular waveform.

Figure 10:
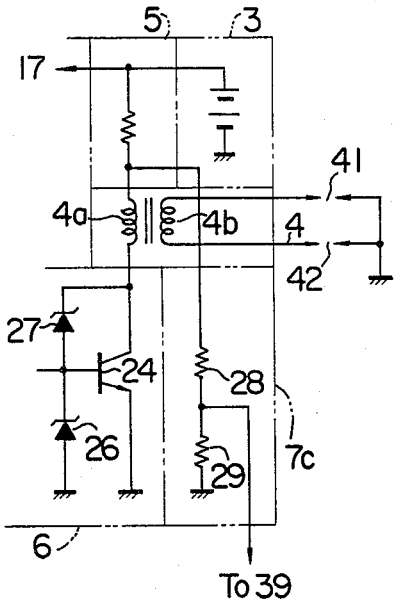
FIG. 10 is an electrical circuit diagram showing the essential parts of a fourth embodiment of the system according to the present invention.

The essential parts of the fourth embodiment of the present invention are shown in FIG. 10. Unlike the first embodiment shown in FIG. 5 in which the unnecessary high secondary voltage generated across the secondary winding 4*b* of the ignition coil 4 is reduced by detecting the collector voltage of the transistor 24, the embodiment of FIG. 10 is such that the voltage-detecting function of the detector circuit 7*c* is performed by connection of the external resistor 5. In other words, by detecting and controlling the voltage drop across the external resistor 5, i.e., the current value of the external resistor 5, the unnecessary secondary high voltage generated across the ignition coil 4 is controlled. For this purpose, the external resistor 5 is used in place of the current-detecting resistor. Also, the primary current is controlled by the saw-tooth wave generator circuit 8 including the capacitor 36.

Figure 11:
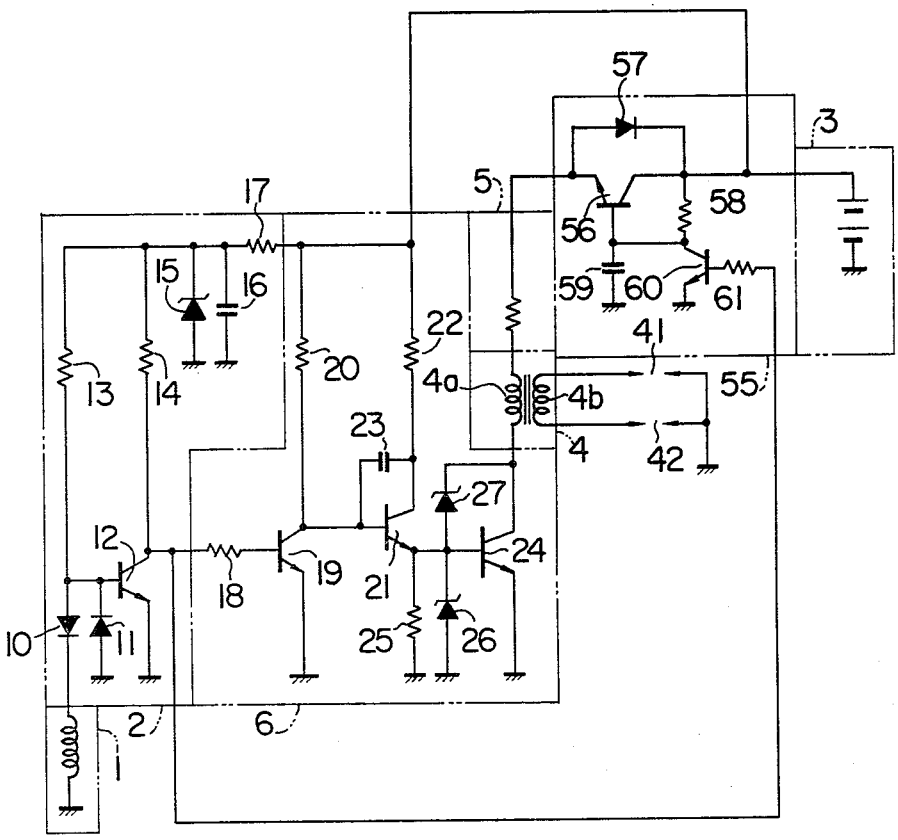
FIG. 11 is an electrical circuit diagram showing a fifth embodiment of the system according to the present invention.

The diagram of FIG. 11 shows the fifth embodiment of the present invention. In synchronism with the ignition signal, the power transistor 24 is turned on and off. The applied voltage control circuit 55 is inserted between the power supply battery 3 and the external resistor 5. By regulating the rise voltage applied to the primary winding 4*a* of the ignition coil 4, the high voltage generated across the secondary winding 4*b* at the time of turning on of the power transistor 24 is reduced. Referring to the configuration of the fifth embodiment shown in FIG. 11, like reference numerals as in the first embodiment shown in FIG. 5 denote the same or like component elements. In the embodiment of FIG. 11, however, a control circuit 55 is inserted between the power supply battery 3 and the external resistor 5. The control circuit 55 includes a primary current power transistor 56, a diode 57 for protecting the transistor 56 from the breakdown voltage, a bias resistor 58 for the transistor 56, a capacitor 59, a discharge transistor 60 for the capacitor 59, and a base resistor 61 for the transistor 60.

The operation of the embodiment under consideration having the above-mentioned configuration will be described. The AC signal from the AC generator 1 is shaped by the waveform shaping circuit 2. When the transistor 12 changes from off to on state, the transistor 19 is turned off and the power transistor 24 turned on. At the same time, the signal from the transistor 12 is connected to the transistor 60, and therefore the transistor 60 is turned off. At the same time that the transistor 60 is turned off, the capacitor 59 begins to be charged through the resistor 58, the time constant for the charging thereof being determined by the resistor 58 and the capacitor 59. The base of the power transistor 56 is connected to the capacitor 59. Since the base current thereof is the same as the current in the capacitor 59, the base current of the transistor 56 rises substantially from zero and increases with time. Since the base of the transistor 56 rises substantially from zero, the emitter potential of the transistor 56 is lower than the base potential by the drop between base and emitter and increases from almost zero at the time constant determined by the resistor 58 and the capacitor 59. The time required for this rise may be controlled by the resistor 58 and the capacitor 59. Thus the primary voltage of the ignition coil 4 may be increased slowly during actuation thereof, with the result that the secondary high voltage generated across the secondary coil 4*b* of the ignition coil 4 may be reduced. The diode 57 has a dual function of protecting the transistor 56 from breakdown voltage and cutting off the primary current when the transistors 24 and 56 are turned off simultaneously at the time of ignition. Also, instead of charging the capacitor 59 through the resistor 58, it is charged through the well-known constant-current circuit shown in FIG. 9, so that the triangular wave voltage is generated in the emitter of the transistor 56 for further improvement.

In the fifth embodiment shown in FIG. 11, it is of course possible for the power transistor 24 to act also as the power transistor 56 by connecting the capacitor 59 and the transistor 60 between the base of the transistor 21 and the earth.

We claim:

1. An ignition system for an internal combustion engine comprising:

pulse generating means for generating a train of pulses having a first and second output levels;

an ignition coil having primary and secondary windings, said primary winding being adapted to be connected in series with an electric power source of said internal combustion engine and said secondary winding being adapted to be connected to at least one spark plug provided on said internal combustion engine;

a transistor connected in series with said primary winding of said ignition coil for energizing and deenergizing said primary winding in response to said first and second output levels of pulses from said pulse generating means applied thereto; and transistor control means for (a) controlling the currents of said transistor in response to the transition of said pulses from said second to first output levels so that an energization current flowing from said electric power source through said primary winding is gradually increased in accordance with a first time constant after the transition of said output pulses from said second to first output levels and (b) controlling the currents of said transistor in response to the transition of said pulses from said first to second output levels so that a deenergization current flows in said primary winding that changes in accordance with a second time constant shorter than said first time constant.

2. An ignition system for an internal combution engine comprising:

pulse generating means for generating a train of pulses having first and second output levels;

an ignition coil having primary and secondary windings, said primary winding being adapted to be connected in series with an electric power source of said internal combustion engine and said secondary winding being adapted to be connected to at least one spark plug provided on said internal combustion engine;

a transistor connected in series with said primary winding of said ignition coil for energizing and deenergizing said primary winding in response to said first and second output levels of said pulses applied thereto; and transistor control means for controlling the currents of said transistor in response to the transition of said pulses from said second to first output levels so that an energization current flowing from said electric power source through said primary winding is gradually increased after the transition of said output pulses from said second to first output levels, said transistor control means comprising:

voltage detecting means connected in parallel with the emitter-collector path of said transistor for detecting a voltage developed across said emitter-collector path;

reference voltage generating means for generating a reference voltage which is gradually decreased after the transition of said pulses from said second to first output levels; and comparison means for comparing said voltage detected by said voltage detecting means with said reference voltage, the output signal of said comparison means indicative of said voltage being smaller than said reference voltage being applied to render said transistor nonconductive.

3. An ignition system for an internal combustion engine comprising:

pulse generating means for generating a train of pulses having first and second output levels;

an ignition coil having primary and secondary windings, said primary winding being adapted to be connected in series with an electric power source of said internal combustion engine and said secondary winding being adapted to be connected to at least one spark plug provided on said internal combustion engine;

a transistor connected in series with said primary winding of said ignition coil for energizing and deenergizing said primary winding in response to said first and second output levels of said pulses applied thereto; and transistor control means for controlling the currents of said transistor in response to the transition of said pulses from said second to first output levels so that an energization current flowing from said electric power source through said primary winding is gradually increased after the transition of said output pulses from said second to first output levels, said transistor control means comprising:

a resistor connected in series with said primary winding of said ignition coil and the emitter-collector path of said transistor;

reference voltage generating means for generating a reference voltage which is gradually increased after the transition of said pulses from said second to first output levels; and comparison means for comparing a voltage produced across said resistor with said reference voltage, the output signal of said comparison means indicative of said voltage being larger than said reference voltage being applied to render said transistor nonconductive.

4. An ignition system for an internal combustion engine comprising:

pulse generating means for generating a train of pulses having first and second output levels;

an ignition coil having primary and second windings, said primary winding being adapted to be connected in series with an electric power source of said internal combustion engine and said second winding being adapted at respective ends for connection to spark plugs provided on said internal combustion engine;

switching means connected in series with said primary winding of said ignition coil for energizing and deenergizing said primary winding in response to said first and second output levels of said pulses, respectively;

control signal generator means for generating a control signal in response to the transition of said pulses from said second to first output levels, said control signal changing gradually with respect to time; and energization control means for (a) gradually increasing an energization current flowing through said primary winding in accordance with a first time constant and in response to said control signal after the transition of said pulses from said second to first output levels and (b) rapidly changing the current flowing in said primary winding in accordance with a second time constant shorter than said first time constant in response to said control signal after the transition of said pulses from said first to said second output levels.

5. An ignition system for an internal combustion engine comprising:

pulse generating means for generating a train of pulses having first and second output levels;

an ignition coil having primary and secondary windings, said primary winding being adapted to be connected in series with an electric power source of said internal combustion engine and said secondary winding being adapted at respective ends to be connected to spark plugs provided on said internal combustion engine;

control signal generating means for generating a control signal in response to the transition of said pulses from said second to said first output levels, said control signal changing gradually with respect to time; and energization control means, connected in series with said primary winding of said ignition coil and responsive to both the pulses of said train of pulses and to said control signal, for (a) energizing said primary winding in response to said first output level of said pulses and to said control signal so that said primary winding is energized gradually in accordance with a first time constant, and for (b) deenergizing said primary winding in response to said second output level of said pulses so that said primary winding is deenergized in accordance with a second time constant shorter than said first time constant.

6. An ignition system for an internal combustion engine comprising:

pulse generating means for generating a train of pulses having first and second output levels;

an ignition coil having primary and secondary windings, said primary winding being adapted to be connected in series with an electric power source of said internal combustion engine and said secondary winding being adapted at respective ends to be connected to spark plugs provided on said internal combustion engine;

control signal generating means for generating a control signal in response to the transition of said pulses from said second to said first output levels, said control signal changing at a predetermined rate with respect to time; and energization control means responsive both to said train of pulses and to said control signal for (a) energizing said primary winding in response to both the transition of the pulses of said train of pulses to said first output level and to said control signal to that current in said primary winding increases responsive to said predetermined rate, said predetermined rate representing a first time constant and (b) deenergizing said primary winding in response to the transition of pulses to said second output level, said deenergizing taking place at second time constant shorter than said first time constant.

7. An ignition system for an internal combustion engine comprising:

pulse generating means for generating a train of pulses having first and second output levels;

an ignition coil having primary and secondary windings, said primary winding being adapted to be connected in series with an electric power source of said internal combustion engine and said secondary winding being adapted at respective ends to be connected to spark plugs provided on said internal combustion engine;

control signal generating means for generating a control signal in response to the transition of said pulses from said second to said first output levels, said control signal changing at a predetermined rate with respect to time; and energization control means responsive to said train of pulses and to said control signal for energizing said primary winding in response to the transition of the pulses of said train of pulses to said first output level and to said control signal so that current in said primary winding increases in accordance with said predetermined rate, and for deenergizing said primary winding in response to the transition of the pulses of said train of pulses to said second output level, the deenergizing occurring at a more rapid rate than the energizing.

* * * * *